US008640644B2

(12) United States Patent
Mauchle et al.

(10) Patent No.: US 8,640,644 B2
(45) **Date of Patent: *Feb. 4, 2014**

(54) POWDER SPRAY COATING METHOD AND DEVICE THEREFOR

(75) Inventors: Felix Mauchle, Abtwil (CH); Christian Marxer, Mauren Fuerstentum (LI); Hanspeter Vieli, Goldach (CH)

(73) Assignee: Gema Switzerland GmbH, St Gallen (CH)

( * ) Notice: Subject to any disclaimer, the term of this patent is extended or adjusted under 35 U.S.C. 154(b) by 754 days.

This patent is subject to a terminal disclaimer.

(21) Appl. No.: 12/680,202

(22) PCT Filed: Sep. 11, 2008

(86) PCT No.: PCT/IB2008/002359

§ 371 (c)(1),
(2), (4) Date: Mar. 26, 2010

(87) PCT Pub. No.: WO2009/040619

PCT Pub. Date: Apr. 2, 2009

(65) Prior Publication Data

US 2010/0221421 A1 Sep. 2, 2010

(30) Foreign Application Priority Data

Sep. 28, 2007 (DE) ..... 10 2007 046 738

(51) Int. Cl.
*B05C 19/00* (2006.01)
*B05C 11/00* (2006.01)
*F04B 49/00* (2006.01)

(52) U.S. Cl.
USPC ..... 118/683; 118/684; 118/308; 118/695; 417/46; 417/187; 700/282; 700/283

(58) Field of Classification Search
USPC ..... 118/308, 309, 683, 695, 696, 684, 708; 239/69, 67, 407, 408, 329–334, 349, 239/351, 355, 356, 363; 417/46, 185, 187, 417/188, 190; 427/180; 700/282, 283
See application file for complete search history.

(56) References Cited

U.S. PATENT DOCUMENTS

| | | | | |
|---|---|---|---|---|
| 5,702,209 | A | 12/1997 | Mauchle | |
| 2006/0093442 | A1 | 5/2006 | Kleineidam et al. | |
| 2007/0092380 | A1 * | 4/2007 | Fulkerson et al. | 417/65 |

FOREIGN PATENT DOCUMENTS

| | | | |
|---|---|---|---|
| EP | 1752399 | A | 2/2007 |
| WO | 03099450 | A | 12/2003 |
| WO | 2005005060 | A | 1/2005 |

OTHER PUBLICATIONS

ISR for PCT/IB2008/002359 dated Feb. 17, 2009.

* cited by examiner

*Primary Examiner* — Yewebdar Tadesse
(74) *Attorney, Agent, or Firm* — Lowe Hauptman & Ham, LLP

(57) ABSTRACT

A powder spraycoating method and powder spraycoating equipment. A dense phase powder pump is used. According to a predetermined conveying-air function in a control unit, different rates of compressed conveying air can be defined for different powder rates. In one predetermined total-air function in the control unit, the sum of total-air rate composed of the rate of compressed conveying air and of the rate of supplemental compressed air can be kept constant even if the rate of compressed conveying air changes.

15 Claims, 2 Drawing Sheets

POWDER SPRAY COATING METHOD AND DEVICE THEREFOR

RELATED APPLICATIONS

Figure 1:
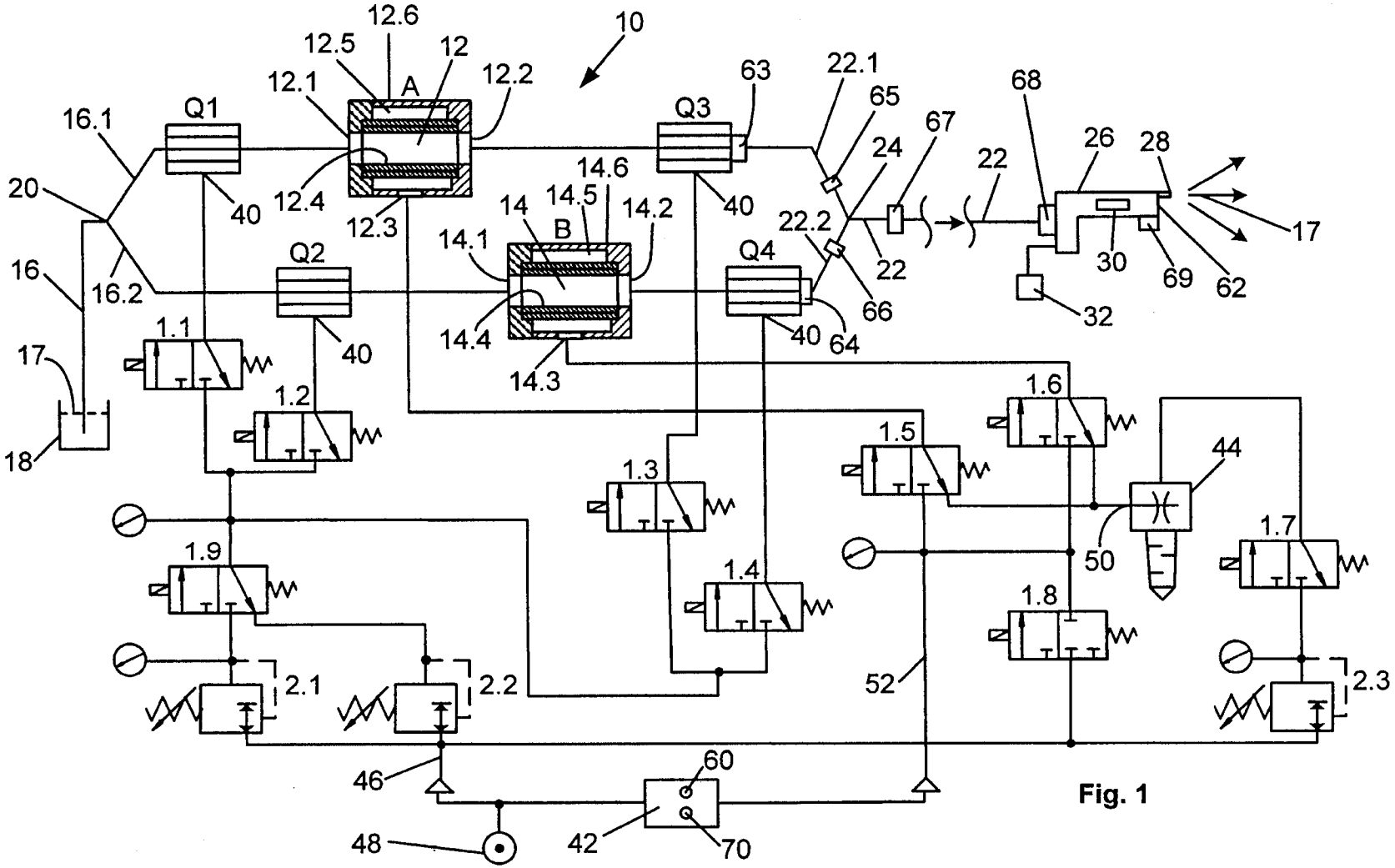

The present application is national phase of International Application Number PCT/IB2008/002359, filed Sep. 11, 2008, and claims priority from German Application Number 10 2007 046 738.0, filed Sep. 28, 2007, the disclosures of which are hereby incorporated by reference herein in their entirety.

The present method relates to a powder spraycoating method and powder spraycoating equipment as defined in the claims and employing dense phase powder pumps.

Dense phase powder pumps contain at least one feed chamber fitted with a powder intake valve and a powder outlet valve. The feed chamber can be alternatively connected to a vacuum source or to a source of compressed conveying air. Powder is aspirated by the vacuum from said vacuum source through the open powder intake valve into the feed chamber while the powder outlet valve is closed. Using the compressed conveying air from the compressed conveying air source the powder present in the feed chamber is discharged through the open powder outlet valve while the powder intake valve is closed. Most dense phase powder pumps comprise two feed chambers operating in time-staggered manner whereby alternatingly coating powder is aspirated into one of the two feed chambers while coating powder is discharged from the particular other feed chamber.

Different kinds of coating powder feed apparatus containing a dense phase powder pump illustratively are known from the following documents which are incorporated by reference herein: JP 09/071,325 A; DE 196 11 533 B4; US 2006/0193704 A (=EP 1 644 131 A2); U.S. Pat. No. 7,150,585 B2 (=WO 2004/087331 A1) and US 2005/0178325 A1 (=EP 1 566 352 A2). A vacuum intake of the minimum of one feed chamber—in some designs also the compressed air intake of the feed chamber—is fitted with a filter permeable to air but not to coating powder. Preferably the filter is made of a sintered material. The powder intake and outlet valves mostly are pinch valves.

The quantity of powder per unit time—hereafter powder rate—fed/delivered by the dense phase powder pump depends on the size (volume) of the feed chamber, on the frequency at which coating powder is aspirated into the feed chamber and then is discharged from it, and the duration the powder intake valve is open. The compressed conveying air mixes only little with the coating powder and moves the coating powder in front of it out of the feed chamber and through the outlet valve.

Different conditions apply for dilute phase powder pumps where the coating powder is moved by injectors acting as the powder pumps. A partial vacuum is generated in the injector by means of a flow of compressed conveying air. Due to this partial vacuum, coating powder is aspirated into said flow. The mixture of compressed conveying air flow and powder then moves from the injector to a target site, for instance a bin or a spray tool. The powder rate moved by the injector depends on the rate of compressed conveying air moving through the injector. Powder spraycoating equipment using an injector illustratively is known from U.S. Pat. No. 4,284,032 which is incorporated by reference herein. U.S. Pat. No. 4,357,900 which is incorporated by reference herein shows powder spraycoating equipment wherein objects to be coated are moved into a cabin where they are coated in sensor-controlled manner by automated spray tools, one sensor being used to alert a control unit at the time an object to be coated arrives in the cabin, when the object enters said tool's spraying range, to activate this tool. Another sensor is used to ascertain the kind of object involved, so that, as a according to this sensor's transmitted electric signals, the powder rate may be automatically set. EP 0 412 289 B1 which is incorporated by reference herein discloses an electrostatic powder spraycoating equipment fitted with an injector and with a device to keep constant the rate of air fed to the spray tool, said air consisting of the compressed conveying air and of supplemental air added to the powder flow. EP 0 636 420 A2 which is incorporated by reference herein shows powder spraycoating equipment fitted with a control unit allowing adjusting the rate of conveyed powder, said control setting the required rate of compressed conveying air and of supplemental compressed air based on the adjusted powder rate, and using stored functions. These functions are stored as mathematical curves.

The objective of the present invention is to improve the efficiency of powder spraycoating methods and equipment employing a dense phase powder pump.

This problem is solved in this invention by its independent claims.

Accordingly the present invention relates to a powder spraycoating method and equipment including:

- The use of a dense phase powder pump containing at least two feed chambers, powder being alternatingly aspirated by vacuum from a powder feed conduit into one feed chamber while powder is discharged by means of compressed conveying air from another of the feed chambers into a powder discharge conduit and is to be sprayed by a spray tool;
- Storing a conveying-air function in a control unit defining—as a function of powder rates to be fed by the dense phase powder pump—associated advantageous rates of compressed conveying air, such rates of compressed conveying air increasing/decreasing with increasing/decreasing powder streams;
- Manual or controlled setting at the control unit of a powder rate to be delivered;
- Automated setting of the advantageous rate of compressed conveying air relating to the set powder rate by the control unit using the stored conveyance function;
- Feeding the set powder rate using the advantageous rate of conveyed compressed air defined by the stored conveyance function from the dense phase powder pump through the powder discharge conduit to the spray tool.

The matching in the present invention of the rate of compressed conveying air to the powder rate is advantageously implemented in that on one hand an adequate rate of compressed conveying air always shall be used for different powder rates and on the other hand no more of said compressed conveying air shall be used than required by the rate of compressed conveyance air. This feature precludes using more compressed conveying air than needed to move the coating powder. Such feature saves energy otherwise wasted on superfluous compressed conveying air.

Moreover the present invention precludes excessive compressed conveying air from exiting the spray tool and thereby expelling powder particles from the spray jet.

The rate of the required compressed conveying air depends on the size of the powder spraycoating equipment, on the kind of coating powder being used, and on the coating thickness implemented on an object to be coated. Illustratively such a rate is in the range between 0.3 and 3.0 $Nm^3/h$ (standard cubic meter per hour).

Further features of the present invention are defined in the dependent claims.

In another invention which is applicable independently of or in combination with the first cited above invention, supplemental compressed air is fed to the powder on the powder path from the dense phase powder pump to a spray tool powder spraying aperture at least at one site of said powder path; a total-air function is stored in the control unit according to which the sum of the setpoint value of the rate of compressed conveying air and the setpoint value of the rate of supplemental compressed air stream always shall correspond to a predetermined total-air setpoint value, and where, if there should be a change in the setpoint value of the rate of compressed conveying air, the setpoint value of the rate of supplemental compressed air stream shall be automatically adjusted in a way that the sum of the changed setpoint value of the rate of compressed conveying air stream and the setpoint value of the rate of supplemental compressed air always shall correspond to the same predetermined total-air setpoint value.

Preferably the total-air function is stored in the form of a curve(s) plot or as a mathematical addition formula or in tabular form and be implemented by a computer processor or a control unit.

This feature offers the advantage of allowing optimizing both the powder conveyance and the powder spray jet. Energy also may be saved this way.

Another advantageous way is to so control the speed of the powder spray jet (powder cloud) that possibly all powder particles may reach the object to be coated, none being expelled from the spray jet or, on account of insufficient kinetic energy, none dropping out of said spray jet, or falling off the object.

Preferred embodiment modes of the present invention are illustratively elucidated below in relation to the appended drawings.

Figure 2:
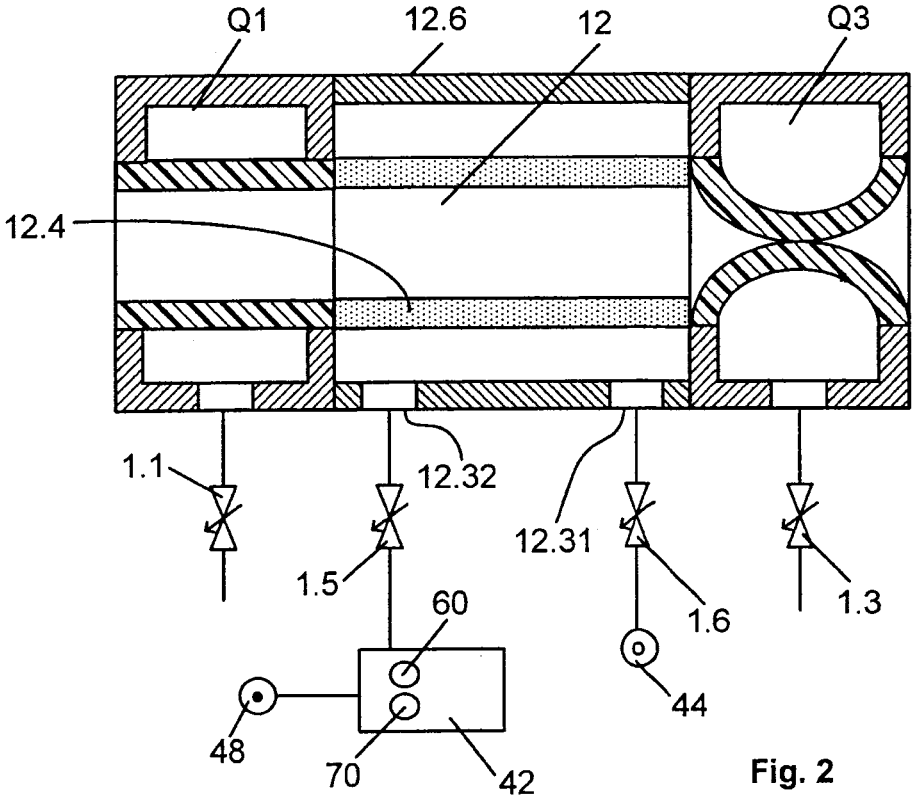
Figure 3:
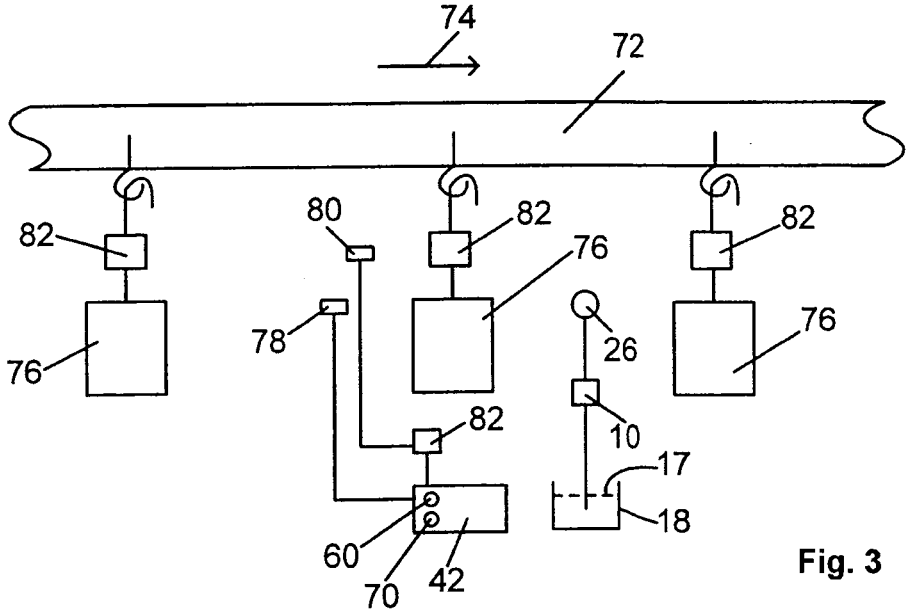

FIG. 1 schematically shows the powder spraycoating equipment of the invention, FIG. 2 is a schematic, longitudinal section of a further embodiment mode of a detail of a dense phase powder pump of FIG. 1, and FIG. 3 shows a powder spraycoating facility containing the powder spraycoating equipment of FIG. 1.

The powder spraycoating equipment schematically shown in FIG. 1 is used to electrostatically spraycoat objects with a coating powder and contains a dense phase powder pump 10 illustratively constituted by two pump parts or pump cylinders A and B. Each cylinder A and B contains a feed chamber 12 respectively 14. Each feed chamber 12, 14 is fitted with a powder intake valve Q1 and Q2 preferably in the form of a pinch valve, at a powder intake 12.1 and 14.1, and a powder outlet valve Q3 and Q4 preferably in the form of a pinch valve, at a powder outlet 12.2 and 14.2. For more clarity, the powder intake valves Q1 and Q2 and the powder outlet valves Q3 and Q4 are shown spaced from the feed chamber 12 respectively 14, actually however they are configured directly at the power intake 12.1 and 14.1 respectively at the powder outlet 12.2 and 14.2.

The powder intake valves Q1 and Q2 are alternatingly fed by means of the control valves 1.1, 1.2 and 1.9, preferably also by means of the pressure regulators 2.2 and 2.1, with compressed control air to close these powder intake valves or vented to open them. The powder outlet valves Q3 and Q4 are fed by means of the control valves 1.3 and 1.4 and the already cited control valve 1.9, optionally through the pressure regulators 2.2 respectively 2.1, with compressed control air to close them or vented to open these powder outlet valves Q3 and Q4.

Compressed air is applied from a compressed air feed conduit 48 by means of compressed air conduits 46 to the said control valves.

The control valve 1.9 and two pressure regulators 2.2 and 2.1 serve to alternatingly close the powder intake valve Q1 and Q2 and the powder outlet valves Q3 and Q4 applying to them two different pressures. Illustratively a low closing pressure may be applied to close the powder valves Q1, Q2, Q3 and Q4 when the dense phase powder pumps 10 are in the feed mode, however a higher pressure may be applied when the feed chambers 12 and 14 are flushed using compressed air. Where only one pressure is desired, the control valve 1.9 and the pressure regulator 2.1 may be eliminated.

The feed chambers 12 and 14 may be alternatingly fed by means of the control valves 1.5 and 1.6 with compressed conveying air using an electronic control unit 42 from the compressed air feed conduit 48 or subjected to a partial vacuum from a vacuum source 44, for instance a vacuum generating injector. Compressed Injector air from the compressed air feed conduit 48 may be applied for instance through a pressure regulator 2.3 and a further control valve 1.7 to the injector 44. All control valves 1.1, 1.2, 1.3. 1.4, 1.5, 1.6. 1.7, 1.8, 1.9 are driven by the same electronic control unit 42.

The control valve 1.8 is required only when the feed chamber 12 and 14 shall not be connected by the control unit 42 to the compressed air feed conduit 48 for the purpose of compressed-air flushing, but is directly connected to said conduit to attain a higher air pressure than that of the compressed conveying air fed to the feed chambers 12 and 14 by means of the control unit 42 and a conduit 52.

The feed chambers 12 and 14 are subtended between the powder intake 12.1 respectively 14.1 and their powder outlet 12.2 and 14.2 by the cylindrical wall of a tubular filter 12.4 and 14.4 which is permeable to air but not to coating powder and which may be made of a sintered material. The filter 12.4 respectively 14.4 is enclosed by an intermediate chamber 12.5 and 14.5 which is externally bounded by a housing 12.6 and 14.6 through which an air exchange aperture 12.3 and 14.3 issues into the intermediate chamber 12.5 and 14.5. The air exchange aperture 12.3 of the feed chamber 12 is connected to the control valve 1.5. The air exchange aperture of the other feed chamber 14 is connected to the other control valve 1.6.

The powder intake sides of the powder intake valves Q1 and Q2 are connected by feed conduit branches 16.1 and 16.2 and a crossing element 20 joining them to a powder feed conduit 16 through which coating powder 17 may be aspirated from a powder bin 18. In a particular embodiment mode, the crossing element 20 and the powder feed conduit 16 may be dropped and instead the two feed conduit branches 16.1 and 16.2 may run directly into the powder bin 18 or into two separate powder containers.

The powder outlet sides of the two powder outlet valves Q3 and Q4 are connected by means of discharge conduit branches 22.1 and 22.2 and a crossing element 24 to a powder discharge conduit 22, preferably a hose which may be connected at its downstream end to a powder spray tool 26.

The powder spray tool 36 may be a spray gun or an automated device. Preferably it includes a high voltage generator 30 and at least one high voltage electrode 28 electrically fed by said generator to electrostatically charge the coating powder.

The control unit 42 may apply a voltage to the high voltage generator 30.

The electronic control unit 42 drives the control valves 1.1, 1.2, 1.3, 1.4, 1.5 and 1.6 in a manner that, during one operational stage, alternatingly coating powder from the powder bin 18 is aspirated from the powder bin 18 through the open intake valve Q1 into one of the feed chambers, for instance 12, while coating powder is expelled from the other feed chamber, for instance 14, by means of compressed conveying air, through the open outlet valve Q4, and that then, during the ensuing operational stage, coating powder is aspirated from the powder bin 18 through the open powder intake valve Q2 for instance of the other feed chamber 14, while coating powder is expelled for instance from the feed chamber 12 through the open powder outlet valve Q3 by means of the compressed conveyance air. This operational alternation is constantly repeated. When coating powder is aspirated into the feed chamber 12 respectively 14, its powder outlet valve Q3 or Q4 is closed. When coating powder is expelled from the feed chamber 12 respectively 14, its powder intake valve Q1 or Q2 is closed.

A conveyance-air function is stored in a memory or as a software in the electronic control unit 42 and defines advantageous rates of compressed conveying air that depend on the powder rates to be conveyed by means of the dense phase powder pump 10, and according to said function, the rate of compressed conveying air increases/decreases as the rate of conveyed powder increases/decreases.

The present invention also makes it possible moreover to keep the rate of compressed conveyed air constant over a range of different powder, for instance in a lower, middle or higher powder rate range.

The electronic control unit 42 comprises a powder rate adjusting element 60 to set a desired powder rate to be fed by the dense phase powder pump 10. The adjustment range of the adjusting element 60 preferably is 0 to 100% of the maximum powder output of said pump 10.

The control unit 42 is designed to automatically set the advantageous rate of compressed conveying air related to the powder rate by means of the stored conveying air function, preferably using a computer. The conveying-air function may be stored in tabular form listing, for a plurality of powder stream rates, an identical plurality of rates of compressed conveying air.

In another embodiment mode the conveying air function may be stored in the form of a plot or a formula.

The powder rate adjusting element 60 may be driven manually or be controlled for instance by another element itself driven by a sensor or according to coating program, such a sensor for instance being able to detect different types of objects to be coated or detecting identifying marks such as labels or codes accompanying the object on its way for instance to the spraycoating cabin, or to a spray tool, in order to be spraycoated accordingly (See FIG. 3)

In another embodiment, at least one source of supplemental compressed air 63, 64, 65, 66, 67, 68 and/or 69 is configured in the powder path between the dense phase powder pump 10 and a powder spray aperture 62 of the spray tool 26 by means of which supplemental compressed air may be fed into the powder flow from at least one site at said path. Illustratively such source of supplemental compressed air may be configured at the sites schematically indicated in FIG. 1, namely at the outlet side of the powder outlet valves Q3 and Q4, upstream or downstream near the crossing element 24, at the transition of the powder discharge conduit 22 into the spray tool 26, within said spray tool for instance near the powder spray aperture 62, in the latter case for instance to enhance the atomizer operation as denoted in FIG. 1 by the references 63, 64, 65, 66, 67, 68 and 69. Instead of being configured at the sites just cited or in addition to them, a supplemental compressed air source also may be configured elsewhere, for instance to feed supplemental compressed air into the feed chambers 12 and 14 (not shown). The control unit 42 drives the minimum of one supplemental compressed air source for instance 63 through 69.

A total-air function is stored in the control unit 42, preferably in the form of a curve(s) plot or a table or a mathematical formula, defining that the sum of the setpoint value of the rate of supplemental compressed conveying air stream and of the setpoint value of the rate of supplemental compressed air of the minimum of one supplemental compressed air device 63 through 69 constantly shall always correspond to an equal, predetermined setpoint value of the rate of the total air being sprayed together with the powder at the spray tool 26. The control unit 42 keeps the rate of total air relating to the total-air function automatically constant at the predetermined setpoint value even when one of the other two setpoint values shall be changed manually or by control because the control unit 42 also automatically changes the particular unchanged setpoint value. If for instance the setpoint value of the rate of compressed conveying air is changed manually or by a program or sensor control, then the control unit 42 automatically resets by means of the total-air function the setpoint value of the rate of the supplemental compressed air in a manner that the sum of the changed setpoint value of the rate of compressed conveying air and the changed setpoint value of the rate of supplemental compressed air shall always remain equal to the setpoint value or the rate of the total-air.

The setpoint value of the total air may be variable, for instance it may be manually adjustable using total-air adjusting element 70 and/or it may be changed by a coating program or by the signals from an object-recognizing sensor. However bus systems such as CAN, Profi-Bus or others may also be used for data transmission, for instance setpoint values and/or control signals.

The adjustment element 60 may be designed either to adjust a powder rate in g/min or to set a percentage of the maximally possible setpoint of the powder rate. In the latter case, illustratively 10% or 50% of the adjustment range also denote 10% or 50% of the maximally possible powder rate.

In relation to the feed chamber 12, FIG. 2 shows that—in lieu of a common air exchange aperture for compressed air and vacuum 12.3 (or 14.3 for the other feed chamber 14), two separate apertures might be provided. FIG. 2 shows a vacuum hookup 12.31 and a separate compressed air hookup 12.32. The vacuum hookup aperture 12.31 can be connected by a control valve 1.6 to the vacuum source 44 and the compressed air hookup aperture 12.32 can be connected through the other control valve 1.5 by means of the control unit 42, for instance through the pressure regulator configured therein, to the vacuum feed conduit 48.

FIG. 3 schematically shows a transport apparatus 72 moving in the direction of advance 74 the object 76 to be coated, for instance into a powder coating cabin, past a spray tool 26, whereby the object 76 can be coated with powder by the spray tool 26. A sensor 78 alerts the control unit 42 when an object 76 has reached a given transportation position. A further sensor 80 is designed either to read a label 82 identifying the object 76 or to read a code affixed to the object 76 or to recognize the kind of object 76 by its structure. The further sensor 80 discloses what kind the object 76 is to a supplemental control unit 82 which in turn communicates the required powder rate to coat the object 76 to the control unit 42. The functions of the supplemental control unit 82 also may be integrated into the control unit 42. In another embodiment mode, the label 82 or the object code may contain coating information, for instance the powder rate and/or the kind of powder and/or a high voltage value that shall be communicated by the sensor 80 to the control unit 42 or to the supplemental control unit 82.

The invention claimed is:

1. Powder spraycoating equipment comprising:

a dense phase powder pump containing at least two feed chambers, the equipment being configured such that alternatingly powder is aspirated by vacuum from a powder conduit into one of the feed chambers while powder is being discharged from another of the feed chambers via compressed conveying air into a powder discharge conduit to be sprayed by a spray tool; and a control unit in which is stored a conveying-air function which, in relation to powder rates to be delivered by the dense phase powder pump defines associated utilitarian rates of compressed conveying air, the rate of compressed conveying air increasing/decreasing with an increasing/decreasing powder rate;

where the control unit is fitted with an adjusting element is configured to adjust a powder rate to be delivered by the dense phase powder pump;

where the control unit is configured to automatically adjust the utilitarian rate of compressed conveying air in relation to the adjusted powder rate using the stored conveying-air function;

the equipment further including valves which are driven by the control unit in a manner that the adjusted powder rate is delivered by the dense phase powder pump at the utilitarian compressed conveying air rate defined by the stored conveying-air function through the powder discharge conduit to the spray tool.

2. Powder spraycoating equipment as claimed in claim 1, wherein the conveying air function is stored in tabular form which can be analyzed by a computer in the control unit and contains, for a plurality of powder rates, an equal plurality of rates of compressed conveying air.

3. Powder spraycoating equipment as claimed in claim 1, wherein the conveying-air function is stored in the form of a curve(s) plot or as a mathematical formula allowing each to be computer processed in the control unit.

4. Powder spraycoating equipment as claimed in claim 1, wherein at least one supplemental compressed air system is provided on the powder path from the dense phase powder pump to a powder spray aperture of the spray tool, said supplemental system allowing feeding supplemental compressed air at least at one site of the powder path into this path; and a total-air function is stored in the control unit wherein the sum of the setpoint value of the rate of compressed conveying air and of the setpoint value of the rate of supplemental compressed air corresponds to a predetermined setpoint value of the total air being jointly sprayed with the powder at the spray tool, where the control unit in the event of a change in the setpoint value of the rate of compressed conveying air automatically adjusts the setpoint value of the rate of supplemental compressed air in a manner that the sum of the changed setpoint value of the rate of compressed conveying air and of the changed setpoint value or the rate of supplemental compressed air corresponds to a predetermined setpoint value of the rate of total air.

5. Powder spraycoating equipment as claimed in claim 4, wherein the total-air function is stored in the form of a curve(s) plot or as a mathematical addition formula, whereby the setpoint value of the rate of supplemental compressed air is given by the total-air setpoint value minus the setpoint value of the rate of compressed conveying air.

6. Powder spraycoating equipment as claimed in claim 4, wherein the total-air function is stored in tabular form containing, for a plurality of setpoint values of rates of compressed conveying air, an equal plurality of setpoint values of rates of supplemental compressed air, each sum given by the setpoint value for a specific rate of compressed conveying air and of the setpoint value of the associated rate of supplemental compressed air always resulting in the same total-air setpoint value.

7. Powder spraycoating equipment as claimed in claim 4, wherein the setpoint value of the total-air rate is variably adjustable.

8. Powder spraycoating equipment as claimed in claim 7, wherein the control unit is fitted with a total-air adjusting element to manually set the setpoint value of the total-air rate.

9. Powder spraycoating equipment as claimed in claim 1, wherein the adjusting element to adjust the rate of the conveyed powder comprises a setting range of 0 to 100%, where the figure of 100% corresponds to the maximum powder rate the dense phase powder pump is able to deliver.

10. Powder spraycoating equipment comprising:

a dense phase powder pump containing at least one feed chamber, the equipment configured to aspirate alternatingly powder by vacuum from a powder conduit into the at least one feed chamber and to discharge the powder from the at least one feed chamber via compressed conveying air into a powder discharge conduit to be sprayed by a spray tool;

a control unit in which is stored a conveying-air function which, in relation to powder rates to be delivered by the dense phase powder pump defines associated utilitarian rates of compressed conveying air, the rate of compressed conveying air increasing/decreasing with an increasing/decreasing powder rate;

where the control unit is fitted with an adjusting element to adjust a powder rate to be delivered by the dense phase powder pump;

where the control unit is configured to automatically adjust the utilitarian rate of compressed conveying air in relation to the adjusted powder rate using the stored conveying-air function; and the equipment is configured such that valves are driven by the control unit in a manner that the adjusted powder rate is delivered by the dense phase powder pump at the utilitarian compressed conveying air rate defined by the stored conveying-air function through the powder discharge conduit to the spray tool.

11. Powder spraycoating equipment as claimed in claim 10, wherein at least one supplemental compressed air system is provided on the powder path from the dense phase powder pump to a powder spray aperture of the spray tool, said supplemental system allowing feeding supplemental compressed air at least at one site of the powder path into this path; and a total-air function is stored in the control unit wherein the sum of the setpoint value of the rate of compressed conveying air and of the setpoint value of the rate of supplemental compressed air corresponds to a predetermined setpoint value of the total air being jointly sprayed with the powder at the spray tool, where the control unit in the event of a change in the setpoint value of the rate of compressed conveying air automatically adjusts the setpoint value of the rate of supplemental compressed air in a manner that the sum of the changed setpoint value of the rate of compressed conveying air and of the changed setpoint value or the rate of supplemental compressed air corresponds to a predetermined setpoint value of the rate of total air.

12. Powder spraycoating equipment as claimed in claim 11, wherein the total-air function is stored in the form of a curve(s) plot or as a mathematical addition formula, whereby the setpoint value of the rate of supplemental compressed air is given by the total-air setpoint value minus the setpoint value of the rate of compressed conveying air.

13. Powder spraycoating equipment as claimed in claim 11, wherein the total-air function is stored in tabular form containing, for a plurality of setpoint values of rates of compressed conveying air, an equal plurality of setpoint values of rates of supplemental compressed air, each sum given by the setpoint value for a specific rate of compressed conveying air and of the setpoint value of the associated rate of supplemental compressed air always resulting in the same total-air setpoint value.

14. Powder spraycoating equipment as claimed in claim 11, wherein the setpoint value of the total-air rate is variably adjustable.

15. Powder spraycoating equipment as claimed in claim 14, wherein the control unit is fitted with a total-air adjusting element to manually set the setpoint value of the total-air rate.

* * * * *